US010317124B2

(12) United States Patent
Hyun

(10) Patent No.: US 10,317,124 B2
(45) Date of Patent: Jun. 11, 2019

(54) COLD AIR DUCT COVER WITH SIDE HOLES USED IN REFRIGERATOR

(71) Applicant: Dongbu Daewoo Electronics Corporation, Seoul (KR)

(72) Inventor: Dai ho Hyun, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 1079 days.

(21) Appl. No.: 14/570,770

(22) Filed: Dec. 15, 2014

(65) Prior Publication Data

US 2016/0097578 A1 Apr. 7, 2016

(30) Foreign Application Priority Data

Oct. 7, 2014 (KR) ..... 10-2014-0134878

(51) Int. Cl.
*F25D 17/06* (2006.01)

(52) U.S. Cl.
CPC ..... *F25D 17/062* (2013.01); *F25D 2317/066* (2013.01); *F25D 2317/067* (2013.01); *F25D 2317/0671* (2013.01)

(58) Field of Classification Search
CPC ..... F25D 17/06; F25D 17/062; F25D 17/065
See application file for complete search history.

(56) References Cited

U.S. PATENT DOCUMENTS

| | | | | | |
|---|---|---|---|---|---|
| 3,455,119 | A * | 7/1969 | Bright | F25D 17/065 | 62/180 |
| 4,920,765 | A * | 5/1990 | McCauley | F25D 17/045 | 62/187 |
| 5,092,137 | A * | 3/1992 | Elsom | F25D 17/045 | 62/408 |
| 5,369,963 | A * | 12/1994 | Pickles | F25D 17/045 | 62/408 |
| 5,911,750 | A * | 6/1999 | Mandel | F25D 17/065 | 62/407 |
| 7,559,211 | B2 * | 7/2009 | Revlett | F25D 17/065 | 62/186 |
| 2008/0202149 | A1 * | 8/2008 | Lim | F25D 17/062 | 62/407 |
| 2010/0125365 | A1 * | 5/2010 | Ahn | F25D 17/065 | 700/275 |
| 2013/0160476 | A1 * | 6/2013 | Lee | F25D 11/02 | 62/291 |

FOREIGN PATENT DOCUMENTS

| | | | | |
|---|---|---|---|---|
| CN | 202485306 U | 10/2012 | | |
| CN | 102927743 A | 2/2013 | | |
| EP | 1174666 A2 * | 1/2002 | F25D 11/022 | |
| KR | 20-2000-0003271 | 2/2000 | | |

* cited by examiner

*Primary Examiner* — Orlando E Aviles
*Assistant Examiner* — Antonio R Febles

(57) ABSTRACT

A duct cover for a cold air duct of a refrigerator and a method of providing cold air. The duct cover has openings located on the side panels which allow cold air to flow to the storage room from the cold air duct in a lateral direction relative to the main panel of the duct cover. A three-dimensional pattern is formed on the surface of the duct cover to reduce surface adhesive between the condensed water drops and the duct cover surface.

12 Claims, 5 Drawing Sheets

COLD AIR DUCT COVER WITH SIDE HOLES USED IN REFRIGERATOR

CROSS-REFERENCE TO RELATED APPLICATIONS

This application claims benefit and priority to Korean Patent Application No. 10-2014-0134878, filed on Oct. 7, 2014, with the Korean Intellectual Property Office, the disclosure of which is incorporated herein in its entirety by reference.

TECHNICAL FIELD

Embodiments of the present disclosure are related to the fields of refrigerators, and more specifically, to mechanisms for cold air dissipation in refrigerators.

BACKGROUND

In general, a refrigerator includes a storage room maintained at a low temperature primarily for storing perishable items, such as food, frozen food, fruits, vegetables, drinks, and etc. The low temperature environment in the storage room is provided by dissipating cold air into the storage room through a cold air duct which has a cover at its outlet to the storage room, or so-called duct cover.

Referring to FIG. 1. The refrigerator 1 has a storage room 2. Racks 3 are optionally installed in the storage room 2. A cold air duct is installed on the wall of the storage room 2, and a duct cover 10 is disposed at the outlet of the cold air duct. The duct cover 10 has holes (or openings) 11 allowing cold air to flow from the cold air duct into the storage room 2.

Stored items can be placed on the racks 3. Some stored items may be contained in a storage container, e.g., a rectangular box or a plastic bag.

Sometimes, a user may place a stored item in front of the holes 11 of the duct cover 10, which inevitably blocks the holes and thereby inhibits the cold air flow from the duct to the storage room. In such a scenario, the cold air flows through the blocked holes and unblocked holes to the storage chamber in different flow rates, undesirably causing an uneven temperature distribution inside the storage room 2.

Further, cold air can be condensed into water drops on the surface of the duct cover 10. The duct cover 10 according to the conventional art has a smooth and even surface and thus water drops can undesirably reside on the surface for extend time before detaching from the surface by gravity. More specifically, as the duct cover 10 has a large surface area, the condensed water drops adhere to the surface with relatively strong adhesive forces. Thereby it is difficult for water drops to separate from the duct cover surface. This tends to cause stains on the surface and compromises its appearance.

SUMMARY

Embodiments of the present disclosure are directed to evenly and efficiently providing cold air in a refrigerator storage room regardless the presence of an external object in front of a duct cover.

Embodiments of the present disclosure provide a duct cover for a cold air duct of a refrigerator with reduced water condensation stain problems.

Embodiments of the present disclosure is not limited to the aforementioned technical objects, and other not-mentioned will be obviously understood from the below description by those with ordinary skill in the art to which the present disclosure pertains.

An exemplary embodiment of the present disclosure provides a duct cover for a cold air duct of a refrigerator, which is provided at a storage room of a refrigerator to discharge cold air to the storage room. The duct cover includes: a main panel; an inner side panel extended from the main panel and provided with first holes; and a guide plate configured to guide cold air flow discharged from the first holes.

A front line corner of the guide plate can be positioned between the main panel and the first holes.

The inner side panel may be formed by bending a portion of the main panel from its lateral surface towards a rear direction. The guide plate may be formed by bending a portion of the inner side panel from its lateral surface toward a front direction.

The duct cover may further include an outside plate formed by bending a portion of the guide plate form its lateral surface towards a rear direction.

The duct cover can further include: an inner bottom panel extended from the main panel at a lower side of the main panel, and provided with second holes; and a bottom guide plate configured to guide a flow of cold air discharged from the second holes.

The duct cover can further include a bottom outside plate formed at an external surface of the bottom guide plate.

The second holes may be formed in plural.

A front line corner of the bottom guide plate may be positioned between the main panel and the second holes.

The bottom guide plate may be connected with the guide plate.

A pattern may be formed in an inclined and with an overall pointed polygonal shape on a surface of the main panel.

The polygonal shape may be a triangular shape, a quadrangular shape, a pentagonal shape, or a hexagonal shape.

The polygonal shape may be shaped as one or a combination of two from a triangular shape, a quadrangular shape, a pentagonal shape, and a hexagonal shape.

Another exemplary embodiment of the present disclosure provides a method of providing cold air of a refrigerator, the method including: a first operation of supplying cold air to a duct cover through a cold air cycle; a second operation of discharging the cold air from a main panel of the duct cover to a lateral surface through first holes of an inner side panel; and a third operation of guiding the cold air by a guide plate formed in the inner side panel and flowing the cold air to the front of the duct cover.

Other detailed matters of the exemplary embodiments are included in the detailed description and the drawings.

According to embodiments of the present disclosure, the duct cover for the cold air duct of the refrigerator has holes that would not be blocked or hidden by an external object placed in front of the duct cover. Therefore, cold air can be efficiently discharged to the storage room, in an even distribution, regardless of the presence of storage item(s) placed proximate to the duct cover.

According to embodiments of the present disclosure, the duct cover for the cold air duct of the refrigerator and the method of providing cold air may cause water drops to detach from the surface of the duct cover efficiently and thereby reduce or even eliminate the water condensation stain issues.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
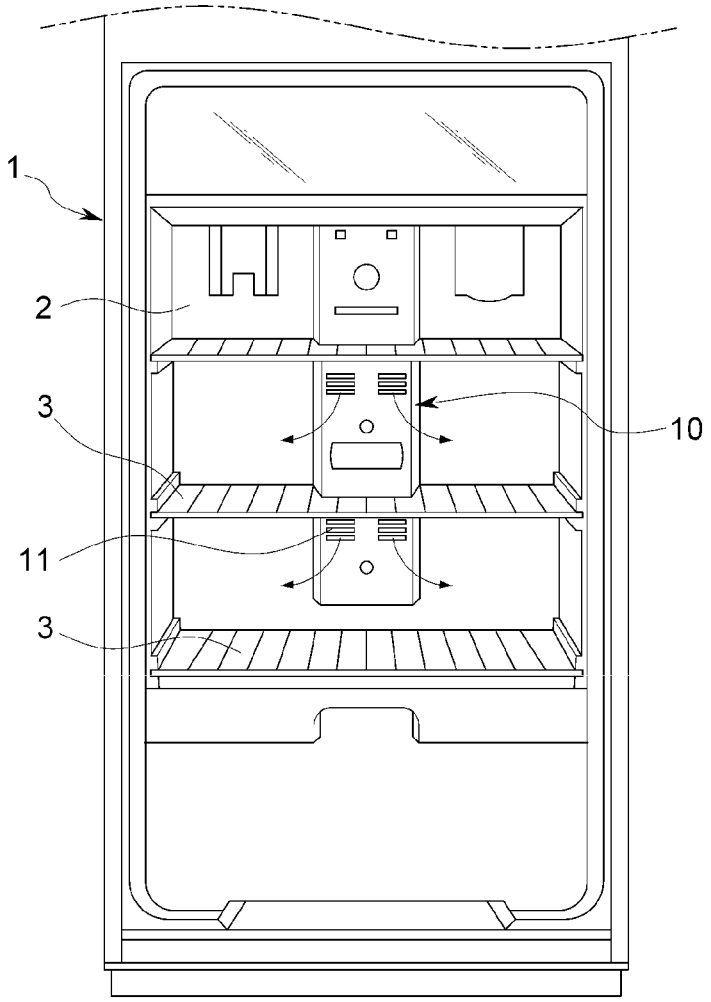
FIG. 1 is a diagram illustrating a refrigerator installed with a duct cover through which cold air is discharged into the storage room in accordance with the prior art.

Advantages and characteristics of the present disclosure, and a method of achieving the advantages and characteristics, will be clear with reference to an exemplary embodiment described in detail together with the accompanying drawings.

Hereinafter, an exemplary embodiment of the present disclosure will be described in detail with reference to the accompanying drawings. It should be appreciated that the exemplary embodiment, which will be described below, is illustratively described for helping the understanding of the present disclosure, and the present disclosure may be variously modified to be carried out differently from the exemplary embodiment described herein. However, in the description of the present disclosure, detailed descriptions and specific drawings for publicly known related functions and constituent elements may be omitted when it is determined that the detailed descriptions and the specific drawings may unnecessarily obscure the subject matter of the present disclosure. The accompanying drawings are not illustrated according to an actual scale, but sizes of some constituent elements may be exaggerated for helping understanding of the present disclosure.

The terms used in the description are defined considering the functions of the present disclosure and may vary depending on the intention or usual practice of a manufacturer. Therefore, the definitions should be made based on the entire contents of the present specification.

Like reference numerals indicate like elements throughout the specification and drawings.

Figure 2:
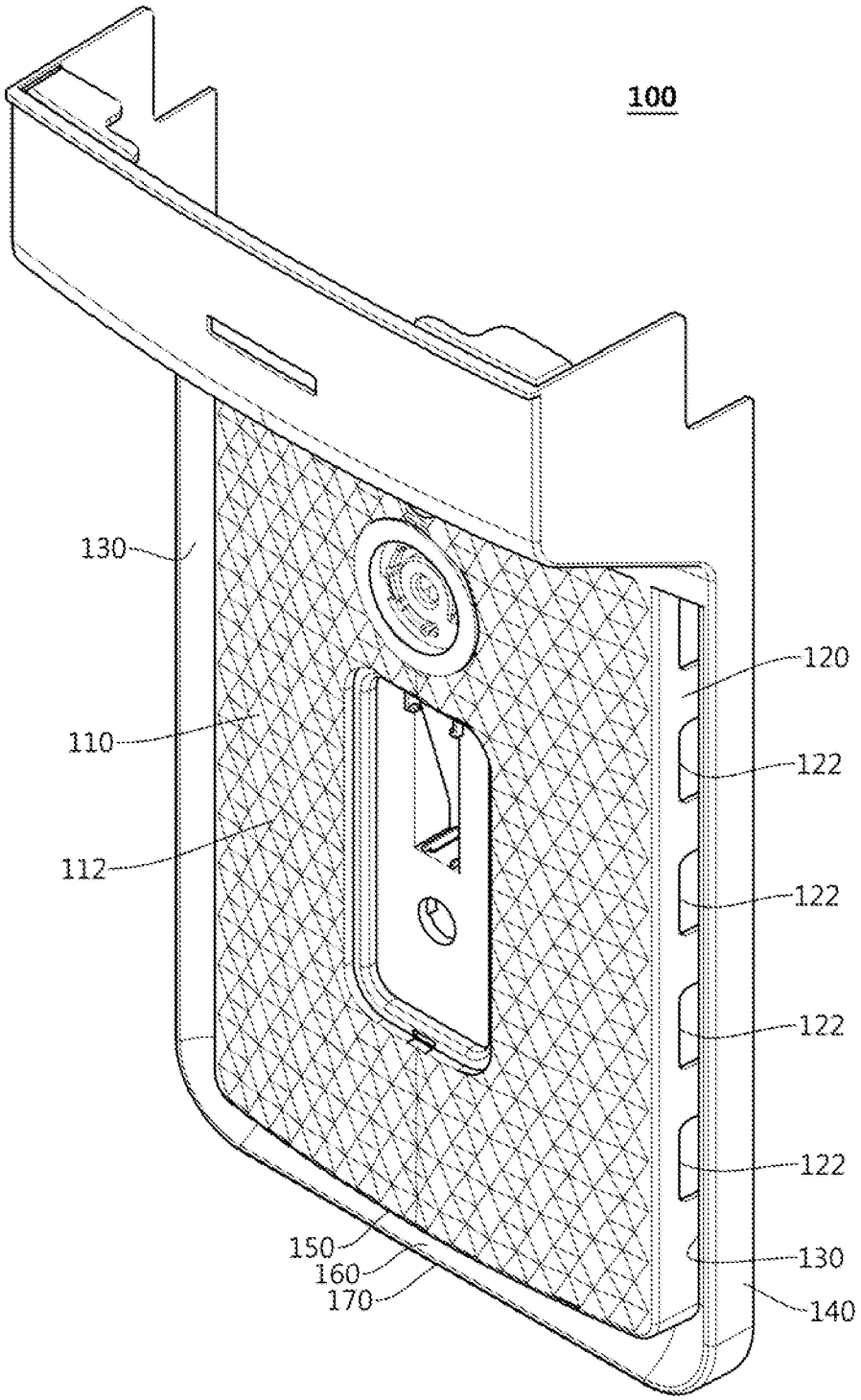
FIG. 2 is a diagram illustrating an exemplary duct cover for a cold air duct of a refrigerator according to an embodiment of the present disclosure.
Figure 3:
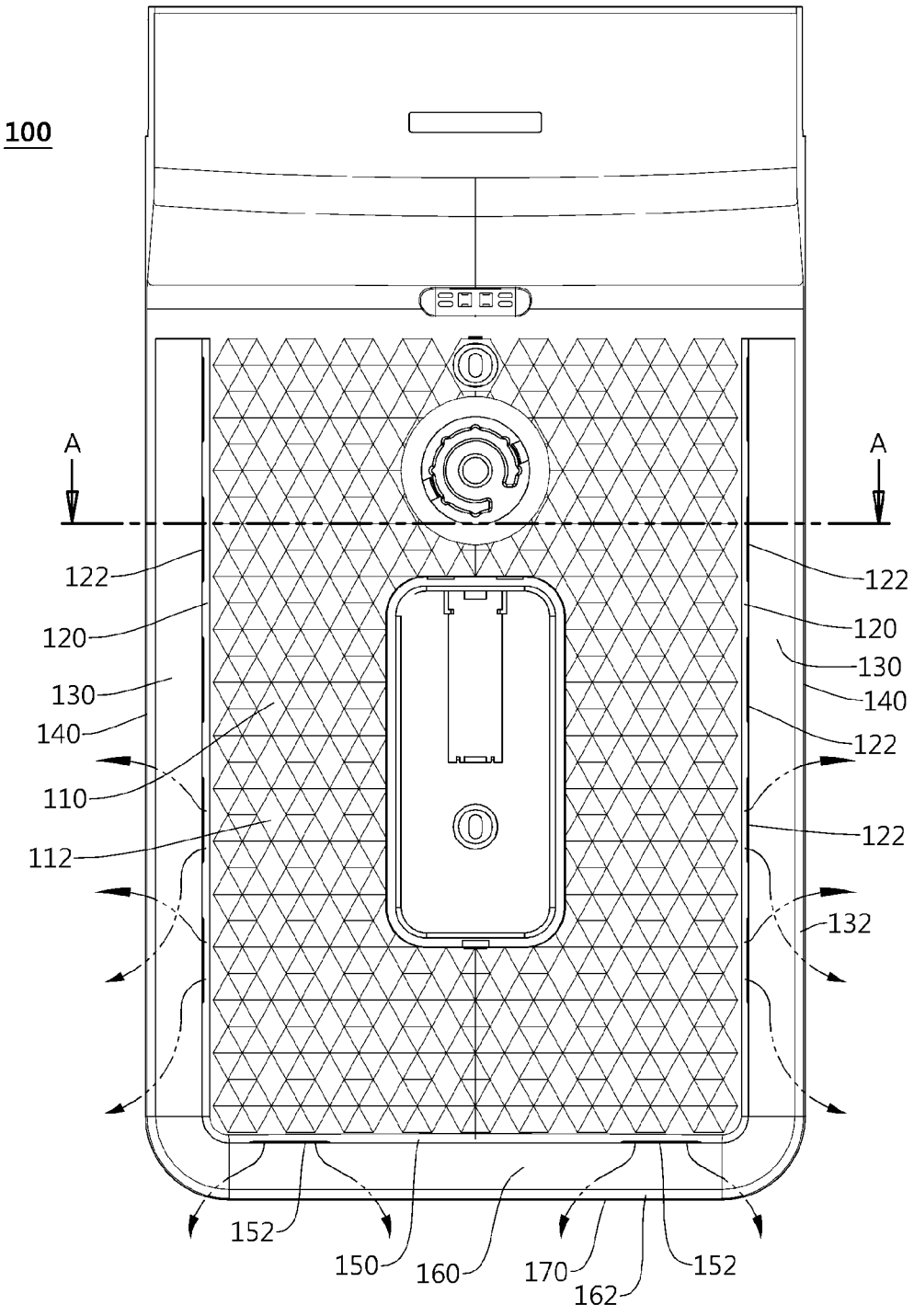
FIG. 3 is a front view of an exemplary duct cover for a cold air duct and the corresponding cold air flow during operation according to an embodiment of the present disclosure.
Figure 4:
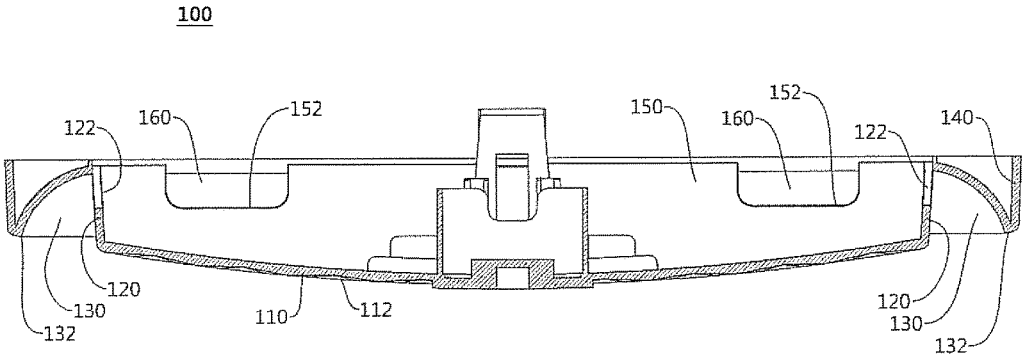
FIG. 4 is a cross-sectional view taken along line A-A of FIG. 3.
Figure 5:
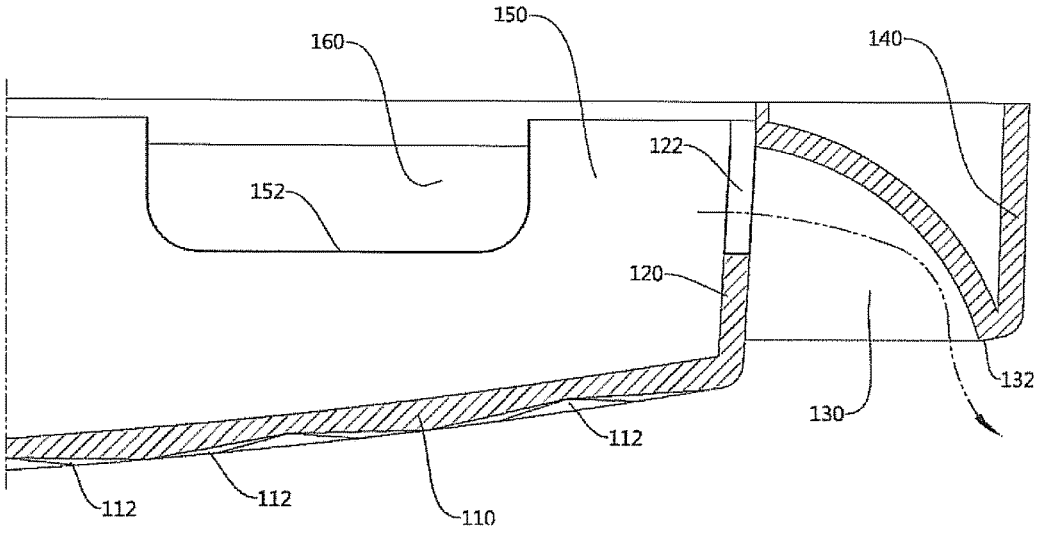
FIG. 5 is a detailed enlarged view of a portion of FIG. 4.

Hereinafter, an exemplary duct cover for a cold air duct of a refrigerator and a method of providing cold air according to an embodiment of the present disclosure will be described with reference to FIGS. 2 to 5. FIG. 2 is a diagram illustrating an exemplary duct cover for a cold air duct of a refrigerator according to an embodiment of the present disclosure. FIG. 3 is a front view of an exemplary duct cover for a cold air duct of a refrigerator and the cold air flow directions during operation according to an embodiment of the present disclosure. FIG. 4 is a cross-sectional view taken along line A-A of FIG. 3. FIG. 5 is a detailed enlarged view of an extracted part of FIG. 4.

A duct cover 100 according to an exemplary embodiment of the present disclosure is installed on the cold air duct of a storage room of the refrigerator. Cold air is discharged to the storage room through the duct cover 100.

The duct cover 100 includes a main panel 110, an inner side panel 120, and a side guide plate 130. An outer side panel 140 is formed at an external side of the side guide plate 130.

The inner side panel 120 is oriented substantially orthogonal to the main panel 110, and has first holes (or other suitable types of openings) 122 through which cold air passes. For example, during manufacturing, the inner side panel 150 may be formed by bending an edge portion of the main panel by 90 degrees. The first holes direct cold air to flow approximately orthogonally to the inner side panel 120, or in a substantially lateral direction with respect to the main panel 110.

The side guide plate 130 is inclined relatively to the inner side panel 120 and serves to divert the cold air flowing through the first holes to the center of the storage room.

Accordingly, even if a stored item is located in front of the main panel 110 of the duct cover 100, the first holes 122 located on the sides of the duct cover 100 allow the cold air to flow unrestricted to the storage room.

The side guide panel 130 can direct the cold air to flow to the front of the duct cover 100. More specifically, the side guide panel 130 is elongated in a vertical direction, so that the cold air can be vertically diffused. Accordingly, as described above, even when an external object (e.g., a stored item) is present in front of the duct cover 100, the cold air can flow without being restricted.

The outer side panel 140 serves to enhance the mechanical strength of the duct cover 100. That is, the outer side panel 140 prevents the main panel 110, the inner side panel 120, and the side guide panel 130 from being deformed.

A plurality of first holes 122 can be formed on the duct cover 110 to achieve an increased flow conductance.

After the cold air flows through the plurality of first holes 122, the cold air may flow within the gap between the inner side panel and the side guide panel 130. Accordingly, even if a certain first hole 122 is covered or blocked (e.g., by an external object), the cold air can move upwards or downwards within the gap and then escape to the center of the storage room of the refrigerator.

In the duct cover 100, a front line corner 132 of the side guide panel 130 can be disposed between the main panel 110 and the first holes 122. The front line corner 132 prevents an external object placed proximate to the duct cover 100 from blocking the first holes. Accordingly, the space defined by the front line corner 132 allows the cold air to smoothly move toward the storage room of the refrigerator.

The duct cover 100 may further include an inner bottom panel 150 and a bottom guide panel 160. An outer bottom panel 170 may be further provided outside the bottom guide panel 160.

The inner bottom panel 150 is oriented substantially orthogonal to the main panel 110 and on a lower side of the main panel 110. For example, during manufacturing, the inner bottom panel 150 may be formed by bending an edge portion of the main panel by 90 degrees. The inner bottom panel 150 has second holes 152 through which cold air can pass.

The bottom guide panel 160 is inclined relative to the surface of the inner bottom panel 150 toward the front of the main panel 110, and serves to direct cold air flow toward the front of the duct cover 100.

Accordingly, when cold air flows from the duct to the storage room, the cold air can flow through the second holes 152. In this configuration, even though an external object is present in front of the duct cover 100, since the second holes 152 are located on the lower side of the duct cover 100, the cold air may nevertheless smoothly and evenly flow to the storage room regardless of presence of the blocking object.

The bottom guide panel 160 can direct the cold air to flow to the front direction. The bottom guide panel 160 is elongated in a horizontal direction, so that the cold air may be horizontally diffused.

The outer bottom panel 170 serves to enhance the mechanical strength of the duct cover 100 and so prevents the main panel 110, the inner bottom panel 150, and the bottom guide panel 160 from being distorted or deformed.

A plurality of second holes 152 may be formed on the inner bottom panel 150 to achieve increased conductance.

Once the cold air flows toward the bottom guide panel 160 through the plurality of second holes 152, the cold air may flow within the gap formed between the bottom guide panel 160 and the inner bottom panel 150. Accordingly, when the cold air cannot smoothly flow toward the front side through a specific second hole 152, the cold air can flow to the left or the right within the bottom guide panel 160 and then escape to the storage room of the refrigerator.

In the duct cover 100, a front line corner 162 of the bottom guide panel 160 can be formed between the main panel 110 and the second holes 152. Accordingly, even though an external object is placed very close to the duct cover 100, a space defined by the front line corner 162 allows the cold air to move smoothly toward the storage room of the refrigerator.

The bottom guide panel 160 may be connected with the side guide panel 130. The cold air passing through the first holes 122 and the second holes 152 may mix and flow within the space defined by the side guide panel 130 and the bottom guide panel 160. Accordingly, even though an object is placed very close to the duct cover 100, the cold air may bypass the object and smoothly escape to the storage room of the refrigerator.

In other embodiments, the duct cover 100 may have an embossed pattern 112 formed in an inclined and all pointed polygonal shape on the surface of the main panel 110 as illustrated in FIGS. 4 and 5. The 3-dimensional embossed pattern 112 advantageously reduces the adhesive force between condensed water drops and the duct cover such that the water drops can easily separate from the duct cover 100 by gravity.

Even when water drops remain on the embossed surface 122, the water drops can reflect the polygonal shape of the pattern 122 or conform into the polygonal shape themselves, thereby advantageously enhancing the aesthetic appearance of the duct cover.

In the duct cover 100, the polygonal shape in the embossed pattern 112 may be a triangular shape, a quadrangular shape, a pentagonal shape, or a hexagonal shape, etc. Accordingly, water drops condensed on the embossed surface 122 can conform into the polygonal shapes.

In the duct cover 100 for the cold air duct of the refrigerator according to the exemplary embodiment of the present disclosure, the polygonal shape formed in the pattern 112 may be one or a combination of two shapes selected from the following: a triangular shape, a quadrangular shape, a pentagonal shape, and a hexagonal shape, etc. Accordingly, when water drops are formed on the embossed surface of the pattern 122, the water drops may create a unique shape, thereby advantageously enhancing the aesthetics of the duct cover 100.

A method of providing cold air in a refrigerator according to an exemplary embodiment of the present disclosure includes supplying cold air from a cold air cycle through the duct cover 100, discharging the cold air from the main panel 120 of the duct cover 100 to the side of the duct cover 100 through the first holes 122 of the inner side panel 120, and guiding the cold air within the gap formed between the side guide panel 130 and the inner side panel and providing the cold air to the front of the duct cover 100.

The aforementioned cold air cycle includes condensing and expanding processes, and also includes a series of technical operations of blowing out cooled gas. The cold air cycle uses well known techniques, so that a more detailed description thereof will be omitted.

As described above, in the method of providing cold air to the refrigerator according to an exemplary embodiment of the present disclosure, the cold air is first discharged in a lateral direction with reference to the main surface of the duct cover 100, and is then diffused within a channel defined by the side guide panel 130 until being discharged to the front of the duct cover. Accordingly, the cold air can be easily diffused without being disturbed by any external obstacle placed proximate to the duct cover 100. This advantageously and effectively maintains an even temperature distribution in the storage room.

Advantageously, the duct cover for the cold air duct of the refrigerator and the method of providing cold air according to the exemplary embodiment of the present disclosure may be used to cause cold air to be diffused to a storage room without being inhibited by an external obstacle placed in front of the duct cover.

Exemplary embodiments of the present disclosure have been described with reference to the accompanying drawings, but those skilled in the art will understand that the present disclosure may be implemented in another specific form without changing the technical spirit or an essential feature thereof.

Accordingly, it should be understood that the aforementioned embodiments are illustrative in every aspect, and are not restrictive. The scope of the present disclosure is represented by the accompanying claims, and it should be construed that a meaning and a scope of the claim, and all changes or modified forms induced from an equivalent concept thereof are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A duct cover for a cold air duct of a refrigerator, the duct cover comprising:

a first panel coupled to the cold air duct and facing a front side of the refrigerator; and an second panel coupled to the first panel and oriented substantially orthogonal to the first panel, wherein the second panel comprises a first opening, wherein cold air is provided from the cold air duct to a storage chamber of the refrigerator via the first opening, wherein the second panel is an inner side panel;

a side guide panel coupled to the inner side panel, wherein cold air discharged from the first opening is operable to diffuse within a space located between the side guide panel and the inner side panel before flowing to the storage chamber, wherein the inner side panel is a bent portion of the first panel towards a rear direction with reference to the refrigerator, and wherein further the guide panel is a bent portion of the inner side panel and bent toward a front direction with reference to the refrigerator, wherein the side guide panel is formed to have a curved surface concave towards the first opening and is arranged to face the first opening, and further comprising an outer side panel formed at an external side of the side guide panel, wherein the outer side pane is a bent portion of the side guide panel and bent toward the rear direction with reference to the refrigerator, wherein further the side guide panel comprises a front line corner disposed between the side guide panel and the outer side panel and is lower than the first panel.

2. The duct cover of claim 1, wherein the second panel further comprises a plurality of first openings distributed vertically along the inner side panel.

3. The duct cover of claim 1, further comprising:

an inner bottom panel coupled to the first panel and oriented substantially orthogonal to the first panel and comprising second openings, wherein the inner bottom panel and the inner side panel are located on adjacent sides of the first panel; and a bottom guide panel configured to guide cold air discharged from the second openings within a channel formed by the bottom guide panel and the inner bottom panel.

4. The duct cover of claim 3, further comprising:

an outer bottom panel formed at an external surface of the bottom guide panel.

5. The duct cover of claim 3, wherein the side guide panel and the bottom guide panel have curved cross sections.

6. The duct cover of claim 3, wherein a front line corner of the bottom guide panel is disposed between the first panel and the second openings.

7. The duct cover of claim 3, wherein the bottom guide panel and the side guide panel are connected.

8. The duct cover of claim 3, wherein the inner bottom panel is a bent portion of the first panel and bent toward a rear direction with reference to the refrigerator, and wherein further the bottom guide panel is a bent portion of the inner bottom panel and bent toward a front direction with reference to the refrigerator.

9. The duct cover of claim 8, further comprising:

an outer bottom panel that is a bent portion of the bottom guide panel and bent toward the rear direction with reference to the refrigerator.

10. The duct cover of claim 1, wherein the first panel is a main panel and comprises an embossed surface pattern comprising pointed polygons.

11. The duct cover of claim 10, wherein the pointed polygons have a shape selected from a triangular shape, a quadrangular shape, a pentagonal shape, and a hexagonal shape.

12. The duct cover of claim 10, wherein the embossed surface pattern is configured to reduce surface adhesion between condensed water drops and the main panel.

* * * * *